United States Patent [19]

Johnson et al.

[11] Patent Number: 4,534,843

[45] Date of Patent: Aug. 13, 1985

[54] APPARATUS FOR ELECTROPLATING AND CHEMICALLY TREATING CONTACT ELEMENTS OF ENCAPSULATED ELECTRONIC COMPONENTS AND THEIR LIKE

[75] Inventors: Frank Johnson, San Jose; Dieter Reese, Simi Valley; Louis Hirbour, Anaheim, all of Calif.

[73] Assignee: Technic, Inc., Cranston, R.I.

[21] Appl. No.: 462,038

[22] Filed: Jan. 28, 1983

[51] Int. Cl.[3] ..... C25D 17/00; C25D 17/06; C25D 17/28; B05C 3/10

[52] U.S. Cl. ..... 204/202; 204/224 R; 204/237; 118/423; 134/75; 134/124

[58] Field of Search ..... 204/237, 202, 203, 204, 204/205, 224 R; 118/404, 423, 429; 134/1, 75, 130, 124, 133

[56] References Cited

U.S. PATENT DOCUMENTS

| | | | |
|---|---|---|---|
| 1,318,053 | 10/1919 | Davoran | 204/203 |
| 2,919,705 | 1/1960 | Vitense | 134/130 |
| 2,935,989 | 5/1960 | Arnold | 204/205 |
| 3,878,062 | 4/1975 | Grimaldi et al. | 204/202 |
| 4,155,815 | 5/1979 | Francis et al. | 204/203 |
| 4,321,124 | 3/1982 | Audelo | 204/202 |
| 4,401,522 | 8/1983 | Buschovy et al. | 204/224 R |
| 4,402,799 | 9/1983 | Ash et al. | 204/224 R |
| 4,402,800 | 9/1983 | Ash et al. | 204/224 R |

FOREIGN PATENT DOCUMENTS

| | | | |
|---|---|---|---|
| 1188206 | 4/1960 | United Kingdom | 204/202 |

*Primary Examiner*—Howard S. Williams
*Assistant Examiner*—Terryence Chapman
*Attorney, Agent, or Firm*—Seymour Rosenberg; Thomas Gunzler

[57] ABSTRACT

An improved apparatus for the plating of the contact elements of encapsulated electronic components - suitably of the type known as P-Dip strips - is provided with a continuous flexible parts-carrier belt of stainless steel, running in a horizontally aligned loop, with the web of the belt vertical. In the lower edge of the belt an array of flexible gripping fingers is formed, provided with projections, suitable for engagement by laterally disposed cams, on alternating sides of the belt for successive grip fingers. A loading device, co-ordinated with the operation of the cams, presents a part to be plated into the gripping fingers during an interval when the belt is stationary and the cams have been activated to separate the tips of the grip fingers. Upon retraction of the cams the parts are securely held by the grip fingers and moved through the plating stations upon the activation of belt motion. After plating, the parts are released by cam action on the grip fingers.

16 Claims, 15 Drawing Figures

Fig.1.
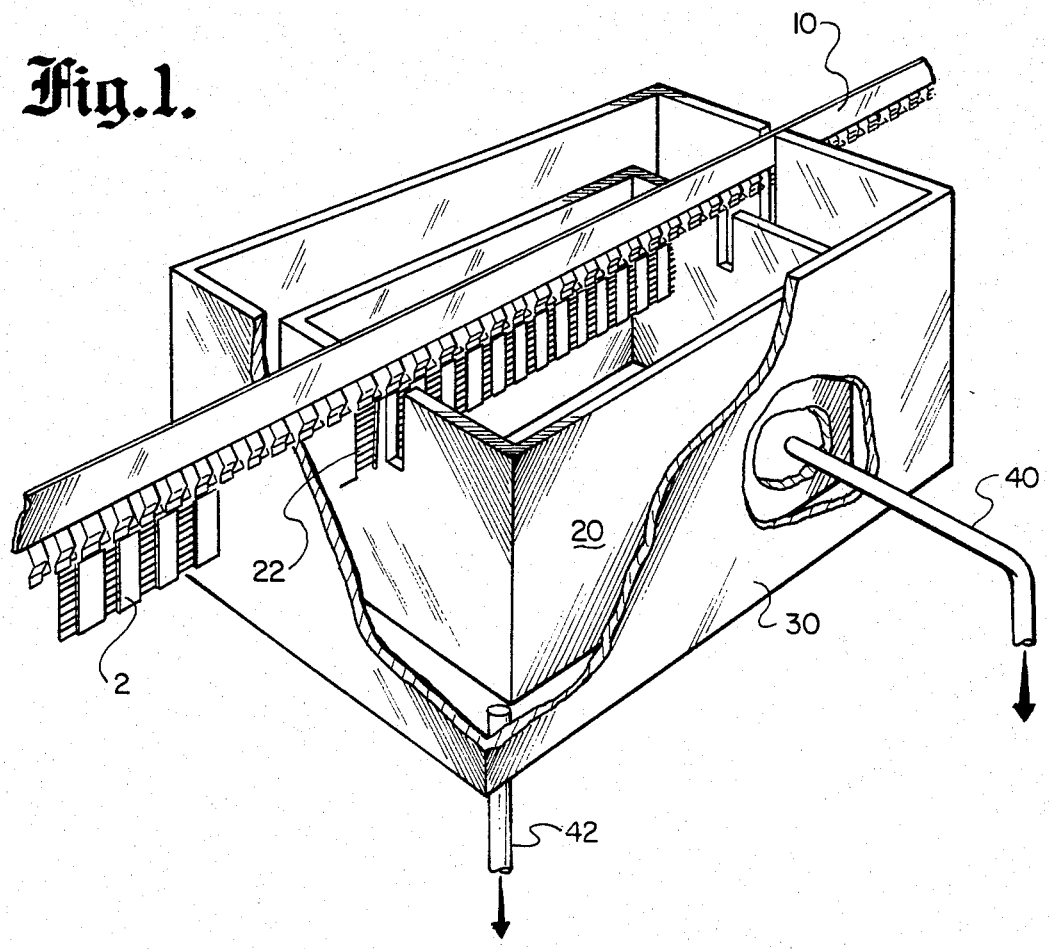
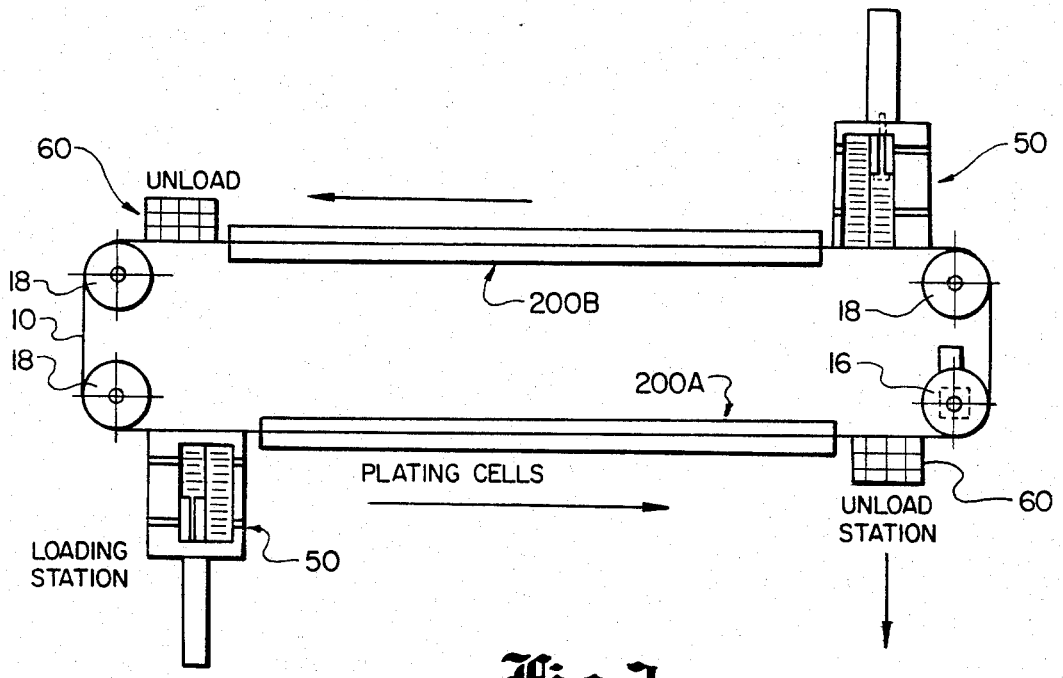
Fig.2.

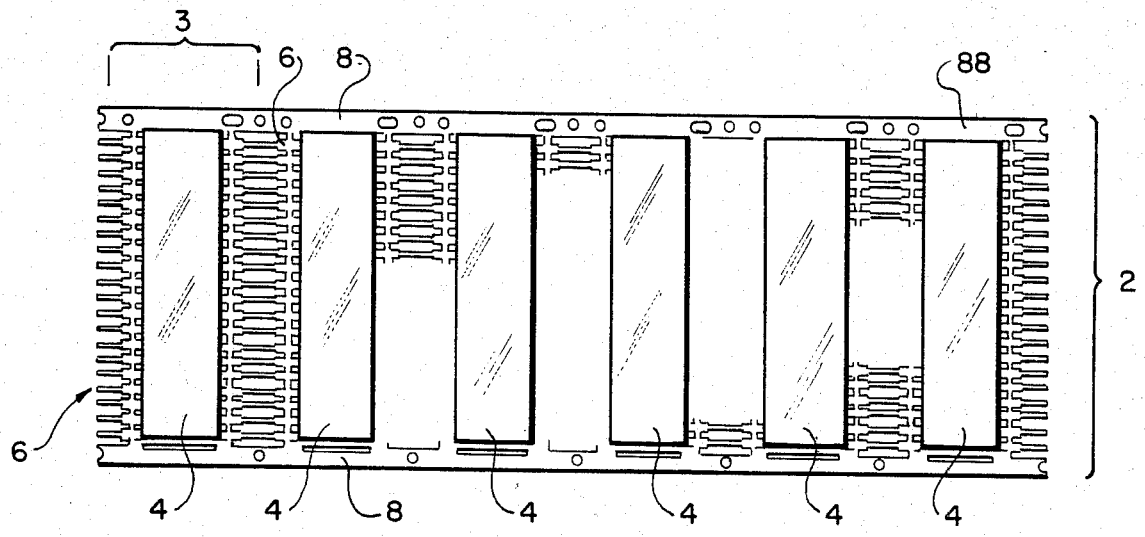
Fig.3.
Fig.4.A.
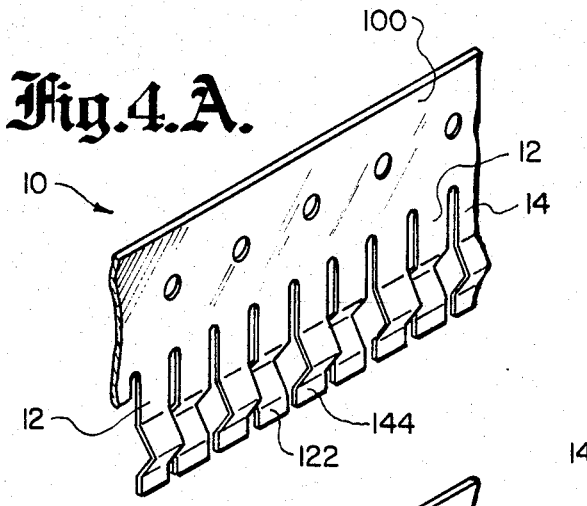
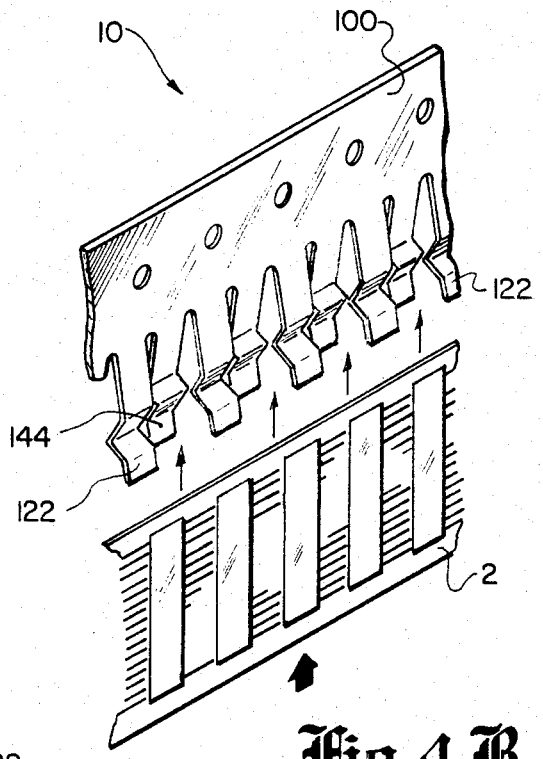
Fig.4.B.
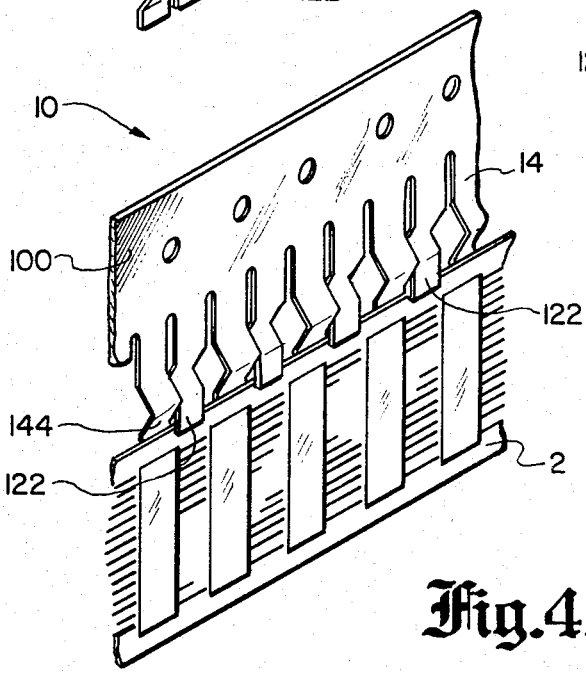
Fig.4.C.

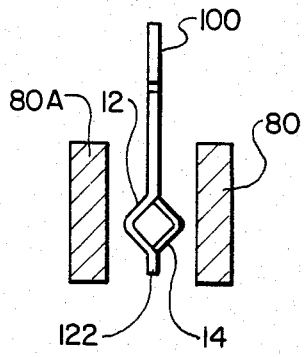
Fig. 5.A.
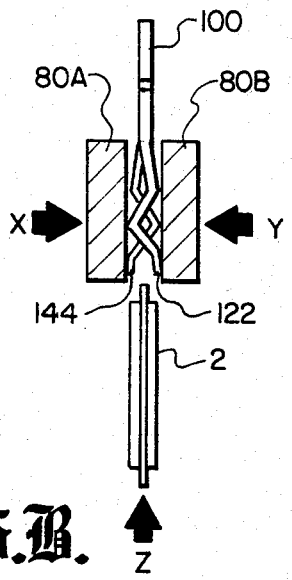
Fig. 5.B.
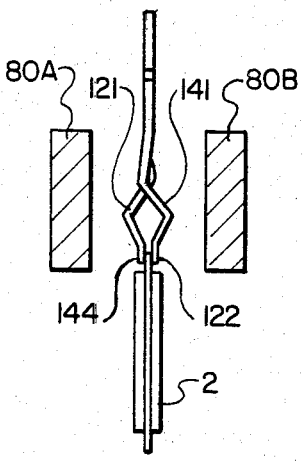
Fig. 5.C.
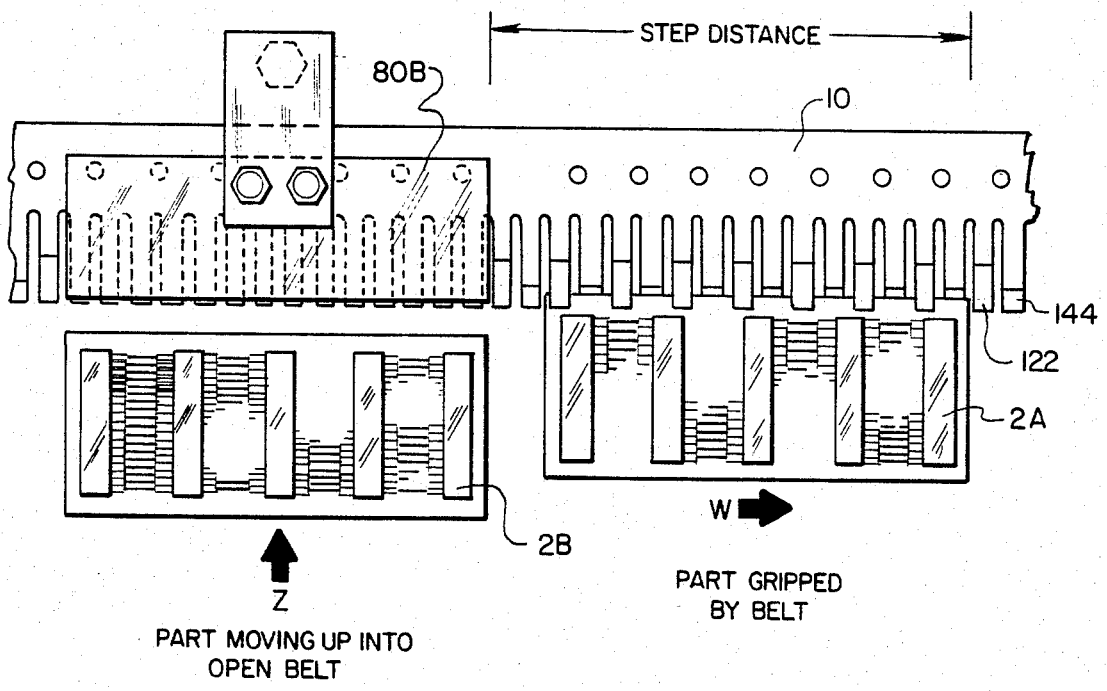
Fig. 6.

APPARATUS FOR ELECTROPLATING AND CHEMICALLY TREATING CONTACT ELEMENTS OF ENCAPSULATED ELECTRONIC COMPONENTS AND THEIR LIKE

BACKGROUND OF THE INVENTION

The invention relates to apparatus for electroplating the contact elements of encapsulated electronic components; it relates, more particularly, to apparatus designed to suspend such encapsulated components, and like devices, from grip means in the lower edges of substantially vertical webs of continuous, flexible conveyor belts which carry the suspended parts through the electrolytic bath where the plating takes place, preceded and followed by such preparatory and consequential treatment stations as may be appropriate to the particular plating process employed.

In the electronic component field it is well-known to manufacture discrete or integrated components which are, after the completion of manufacture encapsulated in an electrically non-conductive mass, such as a plastic, wax, paper or ceramic sheath. To permit the utilization of such encapsulated components, metallic contacts or leads protrude from the sheath. In the general practice of electronic component manufacture such leads—commonly of an iron or copper-based alloy—require plating before final employment.

Plating may be undertaken for several reasons; to provide corrosion resistance, to enhance appearance, and, most commonly, to facilitate interconnection with other electronic components by means of soldering. For the latter purpose plating with metallic tin is commonly employed, often preceded by a thin 'flash' coating of copper in the case of leads made from an iron-based alloy. The leads may be in the form of cylindrical wires, more commonly they are flat tines punched from sheet material.

THE PRIOR ART

In general, the prior art processes utilized in plating the leads of encapsulated electronic components rely on manual loading of the components—commonly in the form of strips of several individual parts or assemblies—onto plating racks or into plating baskets, and sequentially inserting such racks or baskets into the various cleansing and plating solutions used in the preparation of the plated contacts. Alternately, some components may also be plated by means of barrel plating techniques.

Such 'rack plating' and 'barrel plating' techniques are not suited for the production of plated contacts on electronic components for a number of reasons:

- the parts to be treated are small and, generally, fragile, leading to high rates of mechanical damage in the various manual handling and transfer steps in the processes employed;
- the deposition of the plating material is poorly controlled, so that the tight tolerances on the uniformity and thickness of the plating often required are not readily met; and
- as a combination of the above effects and the relatively poor control of the residence time of the parts in chemically active solutions, a relatively large economic loss is sustained when complex parts are found unusable as a result of damage in the plating process, which is commonly the final step in the manufacturing process The prior art also contains devices which convey parts to be plated through a series of treatment stations by means of conveyors or rails. Such developments of the prior art are found in U.S. Patents to CURTIS (U.S. Pat. No. 2,626,621), REID (U.S. Pat. No. 3,066,091), GRIMALDI et Al (U.S. Pat. No. 3,878,062), WELTER (U.S. Pat. No. 3,649,507) and to HELDER Et Al (U.S. Pat. No. 4,032,414). The devices and processes disclosed in these writings of the prior art failed to cure the problems encountered in the plating of contact elements associated with encapsulated electronic components and found no response in the practice of the art.

OBJECTS OF THE INVENTION

The principal object of the invention is to teach the construction of apparatus for electroplating encapsulated electronic component contact elements in which such elements are carried through the treatment stations, including the principal plating bath or baths, on a continuous, flexible conveyor belt constructed from an electrically conductive material, wherein the conveyor belt acts as one of the electrodes of the plating current supply system.

It is another object of the invention to teach the construction of continuous, flexible conveyor belts with elastic grip members disposed along the bottom edge thereof, into which the parts to be plated may be engaged by the action of frictional forces, for conveyance through the plating process steps.

It is a further object of the invention to provide a continuous, automatically operated plating apparatus of the kind described, adapted to the automatic loading of components, and the automatic discharge of finished components therefrom, so as to minimize manual handling and mechanical interference with the parts to be plated.

It is a particular object of the invention to provide plating apparatus adapted to the plating of contact elements associated with encapsulated electronic integrated circuit devices known as P-dips, wherein the active electronic components are ensheathed in elongated prismoidal plastic bodies, with laterally projecting contact tines.

It is yet another object of the invention to teach the construction of plating apparatus as hereinabove described which is capable of rapidly and uniformly plating the projecting contact elements of encapsulated electronic components with a minimum of manual handling, freedom from mechanical damage, and at an economic cost.

It is also an object of the invention to provide apparatus for the treatment of the contact elements of encapsulated electronic devices and hardware associated with such devices by such processes as electroless plating, immersion plating, electropolishing and the application of chemical treatments and processes, such as phosphating and oxidizing processes, for example.

SUMMARY OF THE INVENTION

The above objects—and other objects and advantages which shall become apparent from the detailed description of the preferred embodiment hereinbelow—of the invention are attained in a device which incorporates an endless belt propelled in a continuous horizontally aligned loop to act as a conveyor. The belt proper is constructed from a metallic alloy, suitably a stainless steel with high yield strength, shaped into a flat web of considerable length, minimal thickness, and a width adapted to the particular purpose. The web is formed into the continuous conveyor belt with its width in a substantially vertical plane.

The bottom of the conveyor belt is provided with—integrally in the case of the preferred embodiment—grip means, comprised of adjacent, double-bent fingers of alternatingly assymetrical shape which can interact to grip planar components pressed between adjacent flexible grip fingers.

A loading station is provided for parts, where—in the preferred embodiment—computer-controlled servo-mechanisms spread the flexible fingers of the conveyor belt to receive encapsulated electronic components, individually or in ganged strips, which are offered up into the gripping space by means of coacting devices from a loading magazine. Further along the conveyor, after the parts have passed through the various plating and treatment stations, similar servo-mechanisms release the parts into waiting storage boxes or transfer chutes. The readiness with which the loading and unloading processes can be mechanised is a principal advantage of the plating apparatus of the invention.

Generally, the parts move through a series of preparatory baths—where the surfaces are cleansed, activated, and rinsed—before entering the tank containing the plating electrolyte in which both donor material—tin anode bars, for example—and the parts suspended from the grip fingers of the conveyor belt are submerged. Generally, the donor material and the conveyor belt will be connected to a direct-current electrical supply, forming, respectively, the anode and the cathode of the plating cell. In the preferred embodiment of the invention, the cathode connection is made through one or more sliding contact elements, or brushes in electrical parlance, bearing against the flanks of the conveyor belt proper. Since the belt, and the grip fingers attached thereto, are made of conductive materials and are in electrically conductive contact with one-another—where not actually formed from a single strip—the plating current passes to the contact elements of the encapsulated electronic components via the engripped portions of the contact element array directly.

To ensure that the parts suspended from the grip means of the conveyor belt are fully submerged in the electrolyte, weir slots are provided in the ends of the electrolyte tank, where the conveyor enters and exits the liquid bath. The surface of the liquid in the tank is maintained at, or near, the level of the bottom edge of the belt by means of solution pumps which circulate and replenish the electrolyte flowing through the aforementioned weir slots at variably controlled rates. This allows the plating and ancillary processes to be carried through without vertical motions of the parts to be plated as the parts advance from station to station. The pumping action also serves to maintain the chemical uniformity of the electrolyte solution.

After the completion of the plating process, which may require passage through several plating stations—either to ensure the deposition of sufficient metal for the design purpose, or to permit the successive plating of the parts with different metallic substances—the parts enter another treatment region where they may be subjected to rinsing baths, neutralizing solutions, and, finally, drying processes generally involving the blowing of air, suitably heated atmospheric air, over the previously plated surfaces so as to remove traces of moisture therefrom.

The rinsed and dried parts are discharged from the conveyor belt, suitably into containers or magazines similar to those in which they were originally supplied to the loading station.

In a particularly effective mode of employment of the apparatus of the invention, the return portion of the continuous conveyor belt loop may be advantageously employed to duplicate the entire treatment are plating process, thereby doubling the production capacity of the apparatus without additional investment in conveyor belting, drive means or other components not directly associated with the processing of parts to be plated. It is not necessary, of course, that the plating process performed in the return portion of the machine be identical to that in the primary side; different parts may be subjected to differring series of treatment steps and different plating alloys may be applied to their conductive surfaces, as long as the parts themselves are adapted to be suspended from the grip means associated with the particular conveyor.

The drive means for the conveyor belt may take several forms, such as electric motors, hydraulic devices, etc. either in continuous uniform motion of impelling the belt in its travel direction in a series of steps, with intermediate rest periods. The use of intermittent motion—achieved either by stop-motion drive components, such as the Maltese-cross drive utilized in movie photography or by the use of stepping motors or other means—is particularly advantageous, to provide the opportunity for the operation of the loading and unloading devices to be undertaken with the belt stationary. In the preferred embodiment of the invention, such intermittent motion of the conveyor belt is foreseen, the belt moving on each cycle a distance equivalent to the length of the part to be engaged in the grip means, plus a reasonable increment for clearance between successive parts on the conveyor.

While the principal utility of the apparatus of the invention is in facilitating the application of electrolytic deposition processes to the contact elements of encapsulated electronic components, and to similar items of electronic hardware and devices, it is also possible to apply the apparatus described hereinbelow, with reference to its preferred embodiment used in such electrically motivated deposition processes, to chemical treatment of such components and devices by other processes. Such alternate applications of the apparatus may involve: electroless plating—the deposition of a metallic substance from solution onto the treated surface; immersion plating—involving the exchange of metallic ions from the surface for nobler ones from a solution; phosphating and oxidizing baths; and electropolishing, among others.

BRIEF DESCRIPTION OF THE ACCOMPANYING DRAWING

The preferred embodiment of the invention, and variant embodiments thereof, are illustrated on, and will be described in detail with reference to, the several Figures of the accompanying drawing, wherein:

FIG. 1 is a perspective view of a treatment tank of the the plating apparatus of the invention, traversed by a conveyor belt with integral grip fingers engaging the lead frames of encapsulated electronic components whose contact tines are to be plated in the apparatus;

FIG. 2 is a schematic plan view of a double-sided plating apparatus of the invention;

FIG. 3 is a frontal view of a typical array of encapsulated electronic component advantageously plated with the apparatus of the invention;

Figure 7:
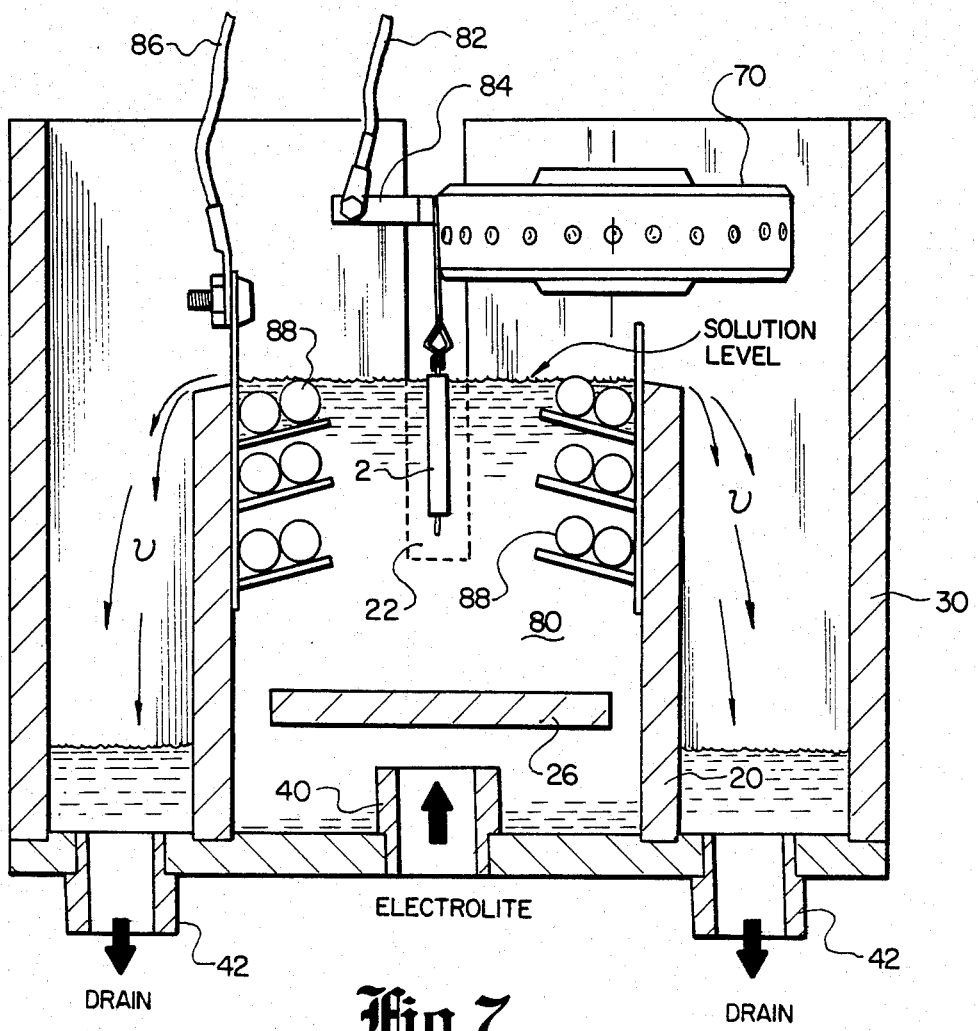
Figure 8:
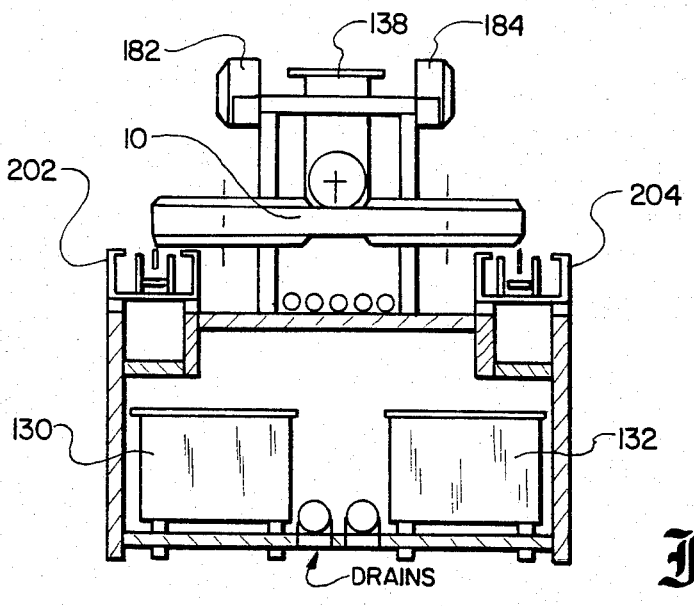
Figure 9:
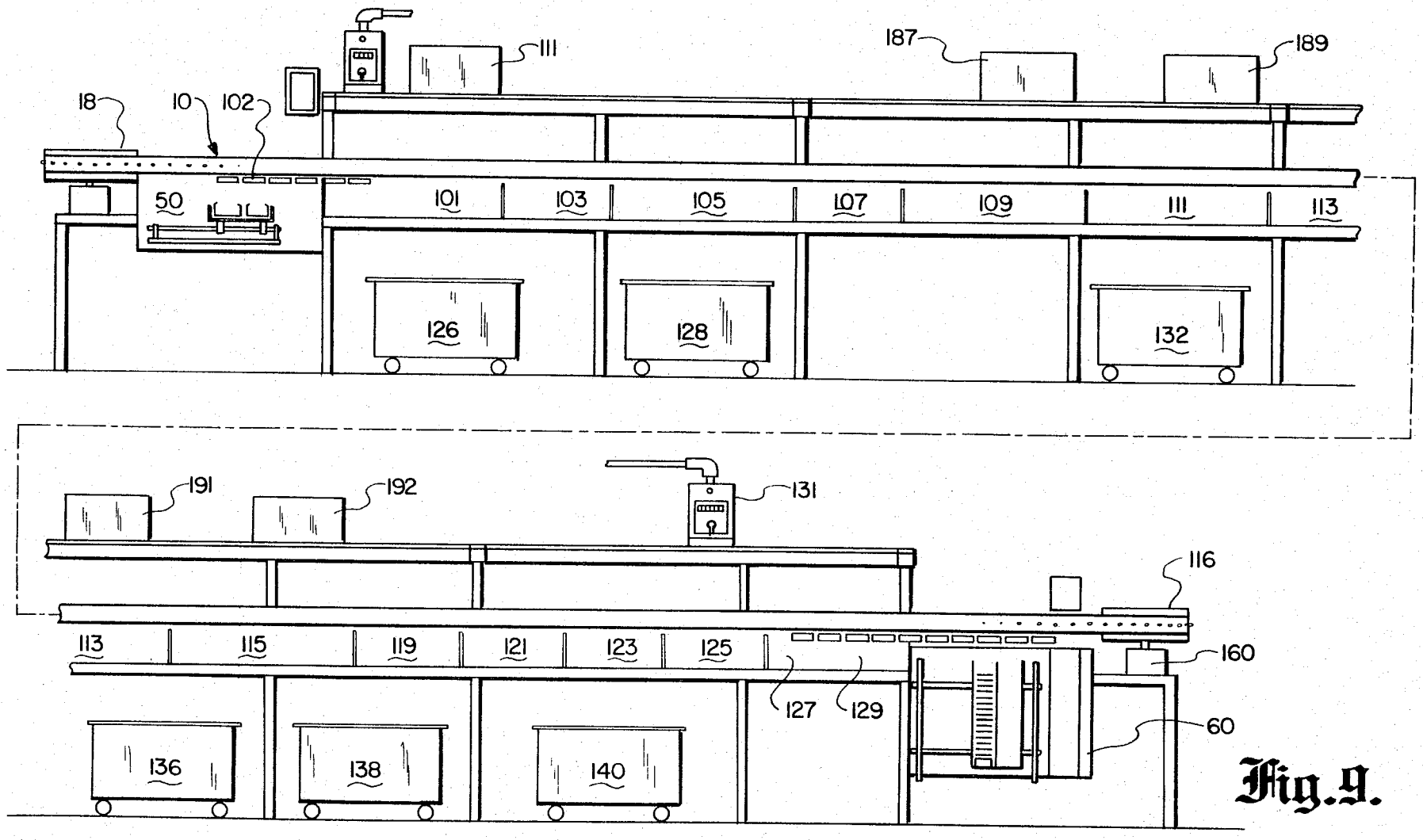
Figures 10, 11:
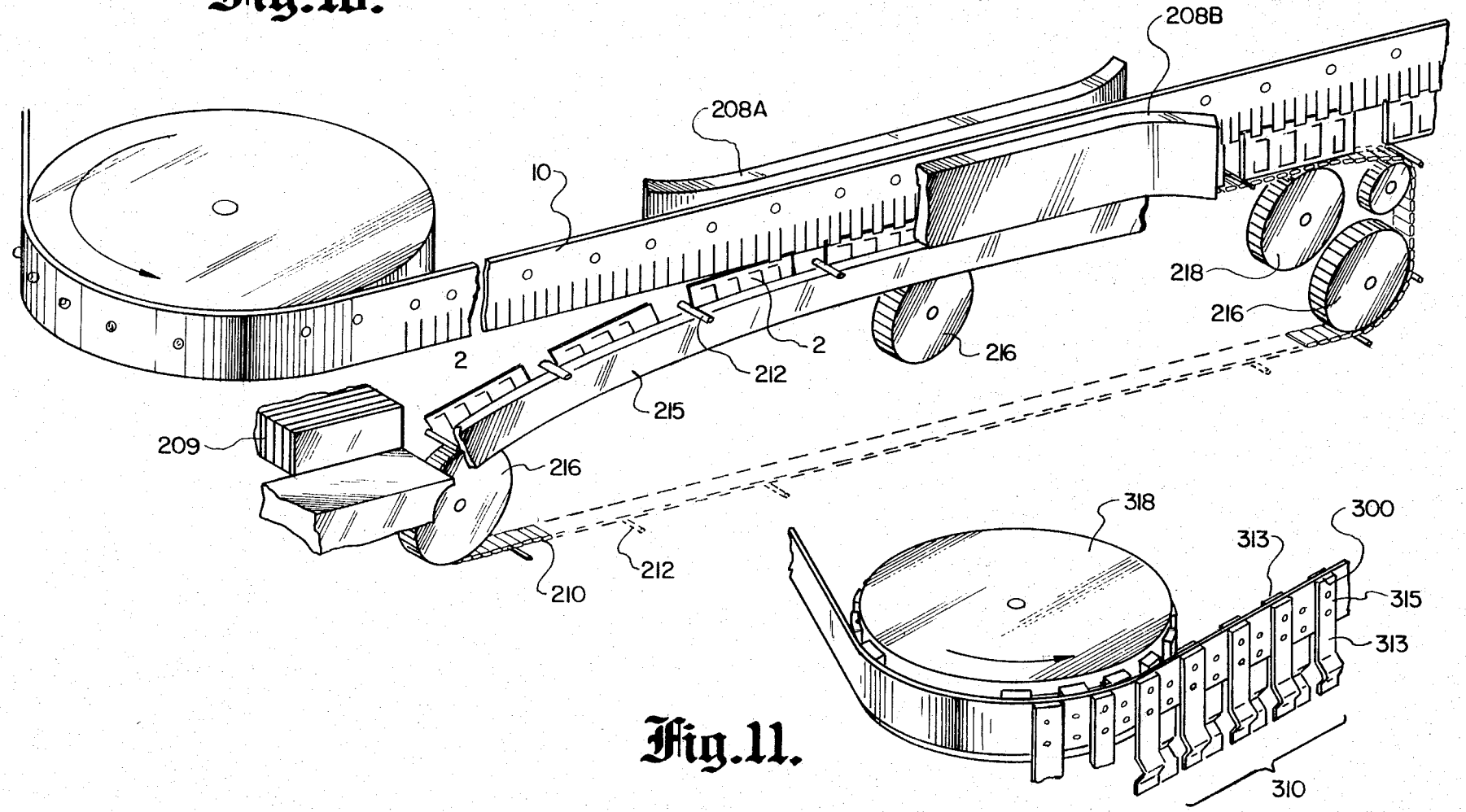

FIG. 4 comprises three perspective views—4A, 4B and 4C—showing the operation of the grip fingers of the conveyor belt incorporated into the apparatus of the invention;

FIG. 5 comprises a set of three transverse sections—5A, 5B, and 5C—through the conveyor belt of the plating apparatus, corresponding to the conditions illustrated in the corresponding view of FIG. 4;

FIG. 6 is an elevation of a portion of the conveyor belt of the plating apparatus, illustrating the successive equipment of work pieces of the grip fingers of the conveyor;

FIG. 7 is a cross-section of a typical treatment tank utilized in a plating stage of the process carried through by means of the apparatus of the invention;

FIG. 8 is a schematic transverse section through the treatment sections of the apparatus shown in FIG. 2;

FIG. 9 is a schematic view, in elevation, of one treatment path of a plating apparatus designed for the tin plating of the contact elements of encapsulated electronic components;

FIG. 10, is a perspective view of a loading station adapted to engage encapsulated electronic components in the grip fingers of a conveyor belt of a plating apparatus of the invention; and FIG. 11 is a perspective view of a segment of conveyor belt utilized in the instant invention with riveted-on grip fingers.

DESCRIPTION OF THE PREFERRED EMBODIMENT

The perspective view of FIG. 1 illustrates a single treatment station of the plating apparatus of the invention with a horizontally aligned conveyor 10 carrying a plurality of parts 2 through a solution tank 20. The conveyor 10 has a substantially vertical, flexible web from which flexible fingers depend to engage the parts 2. The belt runs superposed over a weir 22 at the entrance to the solution tank 20, allowing the parts 2 suspended therefrom to pass through the tank below the surface level of the electrolyte, or other treatment medium, contained therein. A similar weir at the far end of the tank 20 permits the exit of the conveyor-borne components 2 without a change in their vertical position.

The tank 20 is, itself, placed within an overflow container 30, shown with a portion of its circumferential walls cut away for the sake of clarity of illustration, with openings in its ends corresponding to the weirs in the ends of the tank 20 and serving the same purpose. The treatment fluid contained within the tank flows through the weirs into the container 30 and, thence, by means of conduit 42 to a circulating pump. The pump returns the fluid to the interior of tank 20 by means of another conduit 40. The rate of flow through the pump may be varied so as to maintain the desired level of liquid in the treatment tank 20; the pumping action also serving to maintain a high degree of agitation within the tank and, therefore, ensuring the chemical uniformity of the liquid bath surrounding the parts 2.

The treatment station depicted in FIG. 1 is incorporated in plating apparatus generally represented by the schematic plan view of FIG. 2. In the embodiment of FIG. 2 the conveyor belt 10 is guided in a rectangular path by a drive wheel 16 and three idler wheels 18. Plating cells, and ancillary treatment stations, occupy the longer unsupported sides of the rectangle, generally in regions 200A and 200B, in each case preceeded by a loading station 50 and followed by an unloading station 60. Parts to be plated are engaged in the conveyor belt 10 at the stations 50, pass through the plating process stations in regions 200, and are released from the conveyor at unloading stations 60.

FIG. 3 is a frontal view of a typical part 2. The part 2 incorporates a number of encapsulated electronic components 4, each with projecting contact elements 6. The contact elements 6 are part of alead frame 8, comprised of the remaining portions of a panel of sheet metal from which the projecting contact elements 6—as well as corresponding contact portions within the encapsulated volume of components 4—have been punched in an antecedent manufacturing operation. In the case of the particular plating part 2 of FIG. 3, it is the continuous selvedge 88 of the lead frame 8 which serves as the region engaged by the grip fingers of the conveyor belt 10, as described hereinbelow. The edges 88 are trimmed and the contact tines 6 severed, after plating, to form individual electronic components 3.

FIG. 4 comprises three perspective views, each showing a short segment of the continuous, flexible conveyor belt 10. The conveyor belt 10 serves as a part carrier and is provided with a number of grip fingers 12 and 14 projecting below the web 100 of the belt, and cut and formed from the parent material thereof. The grip fingers 12 are in all respects identical to the fingers 14, except for their mirror-image development in sectional view. The grip fingers 12 and 14 are arranged in alternating positions along the belt 10 and are provided with projecting portions, formed by three consecutive bends in opposing directions along the shank of each finger, which serve as bearing points for external cams adapted to entrain the distal portions 122 and 144, respectively, of each finger in opposing directions. The view of FIG. 4A illustrates the relative positions of the belt 10, with its web 100 and a group of alternating fingers 12 and 14, in the 'as manufactured' condition. Such a condition would prevail in those portions of the belt not engaged in carrying parts through the plating stations or passing through the loading and unloading stations.

The view of FIG. 4B, on the other hand, illustrates the positions assumed by the fingers 12 and 14 when engaged by external cams in either the loading station 50 or the unloading station 60 of the plating apparatus. The actual cams have been omitted in this view, for the sake of clarity of illustration, but the relative lateral displacement of the finger tips 122 and 144 has been clearly shown. Also shown is a representative part 2, being impelled upwardly—in a manner which would be consistent with the operation of a loading station 50, or its equivalent—into the gaps formed between adjacent finger tips 122 and 144.

The view of FIG. 4C shows the conveyor belt 10 with the parts 2 engaged by the grip fingers 12 and 14. This view corresponds to the 'working' condition of the conveyor, with parts in the process of passage through the treatment region 200 of a plating machine of the invention.

The three views of FIG. 5 correspond in condition and subject matter the the views of FIG. 4, in transverse section rather than perspective.

FIG. 5*a* shows two adjacent flexible grip fingers 12 and 14 passing between cams 80A and 80B. The lowermost tips 122 and 144 of the grip fingers are in linear alignment, with the latter masked in the sectional view of FIG. 5A by the former.

In FIG. 5B the cams 80A ad 80B are shown in displaced positions—their motions corresponding to the arrows 'X' and 'Y'—towards each other, The co-acting cams 80 secure the displacement of the distal portions 122 and 144 of the flexible, spring-like grip fingers 12 and 14 in opposing directions, creating a longitudinal slot directly below the web 100 of the conveyor belt 10, in the region corresponding to the length of the cams 80—in a direction orthogonal to the plane of section of FIG. 5.

In FIG. 5B a typical part 2 is also shown, being elevated from a position below the conveyor belt into a vertically in the direction of arrow 'Z', where the uppermost portion of the part comes to rest in the longitudinal slot created between successive finger tips 122 and 144. It is to be understood that a sufficient number of flexible fingers 12 and 14 are to be displaced by the cams 80 to accept the full length of the part 2 in the direction orthogonal to the plane of section employed in the view of FIG. 5B.

In FIG. 5C the part 2 has been elevated, as described above, and the cams withdrawn into their rest positions corresponding to that illustrated in FIG. 5A. The withdrawal of the cams 80 brings them out of bearing contact with cam-engaging shoulders 121 and 141—of grip fingers 12 and 14, respectively—and permits the flexibility of the fingers to attempt to return them to their initial postion, as shown in FIG. 5A. With the introduction of the part 2 between the tips 144 and 122 of the grip members, a complete relaxation of the fingers 12 and 14 is now impossible; consequently the uppermost region of part 2 is engaged by the tips 122 and 144 of successive grip fingers and is securely held by the frictional forces corresponding to the cantilever loads imposed on the grip fingers by their displacement from their zero-stress positions.

FIG. 6 is a view, in lateral elevation, of the loading station 50 of a plating apparatus constructed according to the teachings herein, with the operating components omitted from the view, with the exception of a camplate 80B. A part 2A is shown, fully engaged in the grip fingers of conveyor belt 10, being moved, in the sense of arrow 'W', by the motion of the belt. The part 2A is held between a plurality of grip finger tips 122 and 144 in a clearly defined position with respect to the conveyor 10.

In the embodiment represented by FIG. 6, the conveyor belt 10 is operated in an intermittent mode, traversing a distance equivalent to the 'step distance' which is equal to the length of the specific parts 2 being plated plus an allowance to foreclose interference between successive parts on the conveyor. During the intervals when the belt 10 is stationary, servo devices entrain the cams 80 into opening the flexible grip fingers 12 and 14 of the belt, and impel a part, corresponding to part 2B in FIG. 6, in the direction of arrow 'Z' into a position where it can be gripped by tips 122 and 144 upon the release of cams 80 by the aforementioned servo-mechanisms.

FIG. 7 is a transverse section through a plating station of the apparatus, essentially corresponding in its main constructional features to the station illustrated in FIG. 1. A solution tank 20 contains electrolyte bath 80, replenished via a solution inlet fitting 40 by a pump. The solution level in the tank 20 is maintained at the level defined by the upper edge of the tank's circumferential wall with excess electrolyte flowing out of the tank over end weirs, exemplified by weir 22, provided to permit the passage of parts 2 suspensed from the conveyor belt 10, as well as by overflow over the upper edge of the tank itself, as indicated at arrows 'U'. The overflowing solution passes into the overflow tank 30 and, thence, to the intake of the circulating pump via drains 42. A diffuser plate 26 is superposed on the discharge orifice of solution inlet 40 in a spaced relationship and ensures the uniform distribution of the incoming fluid without excessive churning in the plating region between sacrificial anodes 88 and the workpieces 2.

The plating system is conventional, with the anodes 88 connected, via a cable 86 to the positive pole of a direct-current power supply and the workpieces fed from the negative pole of the same supply. The cathode feed is via a cable 82 and a sliding contact, or brush, 84 which bears against the surface of the web 100 of the conveyor belt 10 at a point where it is supported by guide sprocket 70, similar to the idler wheels 18 shown in FIG. 2.

As previously described hereinabove, the conveyor belt 2 is constructed from an electrically conductive material—a stainless steel in the preferred mode of construction—or is a composite structure capable of continuously passing current from the portion contacted by the brush 84 to the gripping fingers 12 and 14 and, thence, to the workpieces 2. It is, of course, understood that those portions—or some segment thereof—of the workpiece 2 in contact with the grip fingers 12 and 14 of the conveyor 10 must be themselves of an electrically conductive nature and must be connected with those portions of the workpiece—contact elements 6 in the case of the part of FIG. 3, for example—which are to be plated with the material of anode bars 88.

In the embodiment of FIG. 7, the anode bars 88 are placed on conductive supports connected to the anode cable 86; in other circumstances a different method of electrical connection with the plating metal—or indeed a different mode or process of plating—may be employed; the actual process of material deposition on the surfaces of parts 2 not forming any part of this disclosure.

FIG. 8 is a transverse section through the embodiment of FIG. 2, showing a plating apparatus with treatment stations along two parallel sides of the recirculating conveyor belt 10. In particular the section of FIG. 8 shows plating tanks 202 and 204 similar in detail to the plating station illustrated in FIG. 7, as well as corresponding DC power supplies 182 and 184 to provide them with plating current. Electrolyte solutions for the stations 202 and 204 are provided from holding tanks 130 and 132; and exhaust duct 138—provided with a suitable exhaust inducer—serves to carry environmentally harmful vapors from the chemically active portions of the apparatus.

FIG. 9 is a view in elevation—in a largely schematic manner—of one treatment path of a typical plating apparatus equipped with the handling devices and treatment stations of the invention. The clear run of the conveyor belt—acting as a part carrier—is between the tangent point on idler wheel 18 at the left of the illustration and the opposite tangent point on drive wheel 16 at the right. The drive wheel 16 is rotated—in an intermittent mode—by an electric drive 160. Parts 102 which it is intended to plate with a tin coating are engaged in the grip fingers of the parts carrier 10 by means of a loading station 50 where the coordinated operation of several servo devices causes the grip fingers to be opened by means of cams—similar to cams 80 of FIGS. 4 and 5, or the equivalents thereof—and the individual parts 102 to be stripped from loading trays or magazines and offered up into the grip fingers, with the subsequent release of the cams 80 and the advance of the conveyor 10 for a predetermined 'step distance' to permit the repetition of the loading process with another part 102.

Once the plating process, whose several steps will be described with reference to the same Figure, is complete, the plated parts—designated items 202, to indicate their changed state from the parts 102 entering the plating apparatus—are removed from the conveyor 10 by means of mechanisms essentially identical to those of loading station 50, in an unloading station 60. The unload station 60 incorporates cams similar to the aforementioned cams 80 which, upon activation, secure a separation of the distal portions 122 and 144 of the flexible grip fingers of the belt 10 and, consequently, allow the plated parts 202 to drop from the conveyor into prepositioned trays, where they are stacked preparatory to their removal—in the case of ganged arrays of encapsulated electronic parts, such as illustrated in FIG. 3—to the final manufacturing operation, the removal of the excess portions of the lead frame, such as edge strips 88, and the separation of the individual encapsulated components with their projecting contact tines 6.

The transformation of incoming parts 102 into plated parts 202 occurs in a number of discrete steps, each involving a particular treatment station and procedure. The parts are first subjected to an electroclean process, involving submersion in an appropriate solution inside station 101—supplied from a tank 126 by a circulating pump—and exposing the parts to an electric current generated in DC supply 111.

The parts leaving station 101 are rinsed with tap water in a rinse station 103 and passed toward activation bath 105. The chemically active solution of bath 105 is stored in tank 128 and pumped through the process station by a circulating pump.

Activation of the surfaces to be plated is followed by yet another water rinse, in station 107, at which time the parts enter four consecutive plating stations 109, 111, 113 and 115. Each of the plating cells 109, 111, 113 and 115 has a dedicated power supply associated with it, designated by index numerals 187, 189, 191 and 192, respectively. The electrolyte for the four sequential plating baths is stored in containers 132 and 136 and is circulated through the actual plating cells by suitable pumps unaffected by the chemical activity of the electrolyte solution.

The plating process of the exemplar plating apparatus is undertaken in four separate cells for the sake of attaining the desired uniformity of the deposited tin metal, as well as the required thickness for the effective soldering of the tines 6 in the ultimate employment of the electronic component parts being treated. Neither the number, nor the actual arrangement of the plating cells used is, in itself, significant, and may be adjusted in ways well known to those skilled in the art of metal deposition by electrolysis.

The plated parts—now properly referred to by the index 202—are carried from the plating cell 115 into a water rinse station 119, followed by a rinsing—or passage through—a neutralizer solution station 121 deriving its treatment fluid from a container 138. The neutralizer restores the chemical, more properly the pH balance of any plating solution still adhering to the parts 202 and prevents any pitting or other imperfections in the newly plated surfaces from developing.

The parts 202 are rinsed, once more, in tap water in station 123 and, conequently, pass through a rinsing bath of deionized water circulated through station 125 from a supply in container 140. In a station 127 air is blown over the surfaces of the parts 202, while the process of air drying is completed in station 129, utilizing air heated under the governance of temperature controller 131.

In the embodiments of FIGS. 4, 5 and 6 a method of engaging parts to be plated in the conveyor belt of the invention was illustrated wherein the motion of the belt was intermittent to permit stationary cam means and feeder devices to be employed. The intermittent motion of parts 2 or 102 through the plating process may influence not only the rate of production but also the deposition rate and distribution of the plated metal. In some instances—to be determined on the basis of experience—one skilled in the art of metal plating may prefer a continuous, uninterrupted movement of the parts to be plated through the various stations of the plating apparatus. The feeding and discharging of parts onto, and from, the conveyor 10 will require a different approach where the belt is moving at a constant speed.

FIG. 10 is a perspective view of a feeding station analogous to station 50 of the embodiment of FIG. 2 but adapted to engage parts 2 in the gripping fingers of conveyor belt 10 while the latter is in continuous motion. A chain-link belt 210 is provided, circulating over idler sprockets 216 and drive sprocket 218 in a loop lying within a vertical plane parallel to the plane of the web of the belt 10, spaced below and, marginally, to one side thereof. The chain is provided with pusher bars 212 spaced from one another at distances corresponding, substantially, to the 'step distance' of FIG. 6, and designed to impel parts 2 from a loader 209 towards the location of cams 8, flanking the the conveyor 10, on a track 215 following the path of the chain 210 and lying directly below the web of the belt 10.

Cams 8A and 8B are symmetrically disposed, rigid members on either flank fo the conveyor belt 10, shaped with arcuate entrance and discharge throats in such a manner that the gripping fingers 12 and 14 of the conveyor belt 10 are gradually urged toward the open position as the belt progresses from the arcuate entrance throat of the cams 8, and reach the fully 'open' position—corresponding to that of FIG. 4B—as the fingers pass through the parallel, central portions of the coacting cams 8A and 8B. The grip fingers 12 and 14 are, subsequently, gradually relaxed into the 'gripping' condition of FIG. 4C as they pass through the expanding exit throat of the cam station, the parts 2 having been, in the same longitudinal region of the apparatus, brought to pass directly between the open tips 122 and 144 of the gripping fingers.

It is understood that the motion of the chain belt 210 and the conveyor belt 10 are precisely synchronized, by a common drive system in the preferred mode of carrying out the invention, so that the parts 2 travel at the same speed as the gripping fingers of the parts carrier 10 as they open and reclose, engripping the uppermost edges of the parts for further conveyance through the plating apparatus.

The partial perspective view of FIG. 11 illustrates one alternate method of construction for the flexible conveyor belt of the plating apparatus; comprised of a web 300 and individual tines 313. The tines 313 are essentially of the same configuration as the gripping fingers 12 and 14 of the conveyor 10 previously illustrated, except for an elongated shank portion 315, and are applied in an alternating mode to either side of the web 300 to which they are fastened, suitably by means of rivets. The combination of the web 300 and the plurality of tines 313 form the conveyor 310 whose employment is analogous to that described for the belt 10.

In the construction of the parts carrier of FIG. 11, the web 300 and the tines 313 are constructed from electrically conductive materials, and the method of jointing them into the belt 310 is selected with a view of maintaining the conductivity of the assembly.

An idler wheel 318 is also visible in FIG. 11, It is an analogue of the idler wheel 18 of FIG. 2, except for the substitution of a crenellated periphery—to engage the shanks of the spaced grip fingers 313—for the projecting pins—designed to mate with spaced perforations in the web 100 of belt 10—found in drive and idler wheels of the embodiment of FIG. 2.

The foregoing description of the preferred embodiment of the invention has covered the principal features of the plating apparatus; it is to be understood that minor mechanical changes, as may be envisioned by those skilled in the art of constructing plating apparatus, upon exposure to the teachings herein, are deemed to be encompassed by the disclosure, which is solely limited by the appended claims. For example, the utilization of plaited or woven fabric of metal wire for the web of the flexible conveyor belt of the invention; provision for replacable grip fingers—in number, spacing, or configuration—to adapt the apparatus for parts of differing characteristics or dimension; or the omission or addition of treatment stations to the apparatus shall not be deemed to deviate from the teachings herein.

We claim:

1. An improved apparatus for electroplating projecting contact elements of encapsulated electronic components, and their like, comprising:

a continuous flexible conveyor belt of electrically conductive material;

guide means for said conveyor belt, constraining the motion thereof in a substantially horizontal plane, with a web of said conveyor belt in a substantially vertical alignment;

grip means, comprised of adjacent, multiply-bent elastic elements of alternatingly assymetrical shape, configured to frictionally engage portions of said contact elements therebetween, arrayed along the distal edge of said conveyor belt and in intimate, electrically conductive contact therewith;

drive means for said conveyor belt;

a plurality of containers for liquid treatment media disposed along the path of said conveyor belt, with at least one of said containers supplied with liquid electrolyte, each such container being provided with weirs in its upper edge adapted to pass the conveyor belt and encapsulated electronic components suspended therefrom inwardly and outwardly of the liquid contained in said tank;

recirculating means, for recovering liquid treatment media escaping from said containers through said weirs and returning such media to said containers, and electroplating current supply means, including at least one electrode disposed within the liquid volume of said one container and at least one current transfer brush in contact with the conveyor belt, for supplying plating current for the deposition of a metallic substance from said electrolyte onto said contact elements.

2. The apparatus of claim 1, wherein said conveyor belt is a continuous web of metallic alloy strip.

3. The apparatus of claim 2, wherein said metallic alloy is a stainless steel.

4. The apparatus of claim 3, wherein said grip means are formed integrally of the material of said continuous web.

5. The apparatus of claims 1 or 4, wherein said elements of said grip means are defined by:

an uppermost portion parallel to the web of said belt;

an intermediate portion displaced outwardly from the plane of the web, on alternating sides of the belt for adjacent elements; and a lowermost portion aligned with the web of the belt.

6. The apparatus of claim 1 or claim 4, additionally comprising:

controller means, adapted to govern the operation of said drive means and said plating current supply means.

7. The apparatus of claims 1 or 4, additionally comprising:

at least one loading station, adapted to insert contact elements of encapsulated electronic components into said grip means in spaced succession from one-another; and at least one unloading station, adapted to remove encapsulated electronic components with electroplated contact elements from the frictional grasp of said grip means.

8. The apparatus of claim 7, additionally comprising controller means, adapted to govern the operation of said drive means, said plating current supply means, said loading station and said unloading station.

9. The apparatus of claim 8, wherein said drive means impel the conveyor belt into intermittent motion.

10. The apparatus of claim 1, additionally comprising treatment means adapted to expose said encapsulated electronic components to treating fluids in their travel along said conveyor belt.

11. The apparatus of claim 9, wherein said intermittent motion is governed by said controller means in such a manner that the operation of said loading and unloading stations occurs during periods of cessation of conveyor belt motion.

12. The apparatus of claim 10, wherein said treatment means includes at least one nozzle disposed below said grip means along the path of said conveyor belt, adapted to bathe encapsulated electronic components held in said grip means in a gaseous treatment fluid.

13. The apparatus of claim 12, wherein said gaseous treatment fluid is atmospheric air, adapted to evaporate liquid entrained on the external surfaces of said encapsulated electronic components.

14. An improved apparatus for applying surface chemical treatments to projecting contact elements of encapsulated electronic components, and like devices, comprising:

a continuous flexible conveyor belt of electrically conductive material;

guide means for said conveyor belt, constraining the motion thereof in a closed loop defined by a substantially horizontal plane, with a web of said conveyor belt in a substantially vertical alignment;

grip means, comprised of adjacent, multiply-bent elastic elements of alternatingly assymetrical shape configured to frictionally engage portions of said contact elements therebetween, arrayed along the distal edge of said vertically aligned conveyor belt and in intimate contact therewith;

drive means for said conveyor belt; and at least one container for liquid treatment medium disposed along the path of said conveyor belt, said container being provided with weirs in its upper edge, adapted to pass the conveyor belt, and the components suspended therefrom, inwardly and outwardly of the liquid contained in said container.

15. The apparatus of claim 14, wherein said grip means are formed integrally of the material of said continuous web.

16. The apparatus of claims 14 or 15, additionally comprising at least one loading station, for engaging said components with said grip means, and at least one unloading station, adapted to disengage such components from said grip means.

* * * * *